US009956759B2

(12) United States Patent
Richards

(10) Patent No.: US 9,956,759 B2
(45) Date of Patent: May 1, 2018

(54) THREE-AROUND BROADSHEET NEWSPAPER PRINTING PRESS AND METHODS

(75) Inventor: John Sheridan Richards, Barrington, NH (US)

(73) Assignee: Goss International Americas, Inc., Durham ( * ) Notice: Subject to any disclaimer, the term of this patent is extended or adjusted under 35 U.S.C. 154(b) by 2155 days.

(21) Appl. No.: 12/435,853

(22) Filed: May 5, 2009

(65) Prior Publication Data

US 2009/0282998 A1 Nov. 19, 2009

Related U.S. Application Data

(60) Provisional application No. 61/135,705, filed on Jul. 23, 2008, provisional application No. 61/126,434, filed on May 5, 2008.

(51) Int. Cl.

| | |
|---|---|
| ***B41F 13/56*** | (2006.01) |
| ***B41F 13/60*** | (2006.01) |
| ***B41F 13/58*** | (2006.01) |
| ***B41F 13/193*** | (2006.01) |
| ***B65H 45/28*** | (2006.01) |
| ***B41F 7/02*** | (2006.01) |
| ***B42D 7/00*** | (2006.01) |

(52) U.S. Cl.

CPC ..... *B41F 13/60* (2013.01); *B41F 7/025* (2013.01); *B41F 13/193* (2013.01); *B41F 13/58* (2013.01); *B42D 7/00* (2013.01); *B65H 45/28* (2013.01)

(58) Field of Classification Search

CPC .... B41F 7/04; B41F 7/12; B41F 13/56; B41F 13/58; B41F 13/60; B41F 13/193; B65H 45/28; B65H 45/30; B42D 7/00

USPC ..... 101/217, 226–228, 417; 270/49, 50; 493/424, 476

See application file for complete search history.

(56) References Cited

U.S. PATENT DOCUMENTS

| | | | | |
|---|---|---|---|---|
| 1,970,931 A | | 8/1934 | Crafts | |
| 2,821,134 A | * | 1/1958 | Brodie | 101/217 |
| 3,610,147 A | | 10/1971 | Crissy et al. | |
| 4,635,915 A | * | 1/1987 | Sato | 270/49 |

(Continued)

FOREIGN PATENT DOCUMENTS

WO WO 2009/120582 A2 10/2009

OTHER PUBLICATIONS

Postpress best hope for newspapers' future?, Chuck Moozakis, Oct. 2006, The International Journal of Newspaper Technology, http://www.newsandtecharchives.com/issues/2006/10-06/nt/10-06_postpress.htm.*

(Continued)

*Primary Examiner* — Jill Culler
*Assistant Examiner* — Marissa Ferguson Samreth
(74) *Attorney, Agent, or Firm* — Davidson, Davidson & Kappel, LLC; Jennifer L. O'Connell; William C. Gehris

(57) ABSTRACT

A broadsheet newspaper printing press is provided including an image carrier carrying three images around in broadsheet newspaper format. The image carrier transfers the three images to a web. The broadsheet newspaper printing press also includes a folder for imparting a longitudinal fold to the web and cutting the web into broadsheet newspaper pages. The folder includes a cylinder cross-folding the broadsheet newspaper pages off center. A web offset broadsheet newspaper printing press also is provided. Methods are also provided.

10 Claims, 10 Drawing Sheets

(56) References Cited

U.S. PATENT DOCUMENTS

| | | | | |
|---|---|---|---|---|
| 6,082,724 | A | 7/2000 | Kahlig et al. | |
| 6,358,192 | B1 * | 3/2002 | Michalik | 493/424 |
| 6,367,792 | B1 | 4/2002 | Chagnon | |
| 6,547,232 | B2 * | 4/2003 | Herda et al. | 101/232 |
| 6,606,944 | B1 * | 8/2003 | Athans et al. | 101/224 |
| 6,688,224 | B2 | 2/2004 | Herda et al. | |
| 6,733,431 | B2 * | 5/2004 | Dufour | 493/428 |
| 6,752,751 | B2 | 6/2004 | Jackson et al. | |
| 6,935,234 | B2 | 8/2005 | Walczak et al. | |
| 7,073,435 | B2 | 7/2006 | Vrotacoe et al. | |
| 2004/0014580 | A1 * | 1/2004 | Kitai et al. | 493/432 |
| 2004/0079247 | A1 | 4/2004 | Dylla | |
| 2007/0101881 | A1 * | 5/2007 | Bitzl et al. | 101/228 |
| 2007/0161486 | A1 | 7/2007 | Richards | |
| 2007/0221076 | A1 | 9/2007 | Reardon | |
| 2007/0261576 | A1 | 11/2007 | Muller et al. | |
| 2009/0241787 | A1 | 10/2009 | DiGenova | |
| 2009/0241790 | A1 | 10/2009 | DiGenova | |
| 2009/0241793 | A1 | 10/2009 | DiGenova | |

OTHER PUBLICATIONS

International Search Report and Opinion of International Searching Authority for PCT/US2009/042856 (9 pages).

* cited by examiner

Cylinder Position 0°

Cylinder Position 90°

Cylinder Position 180°

Cylinder Position 270°

(Perspective)

(Front-opened)

(Front-folded)

(Back-with Inserts)

(Perspective-with Other Papers)

(Unfolded Completely)

| Original ROP Cutoff ($H_1+H_2$) | New ROP Cutoff $2(H_1+H_2)/3$ | Insert Cutoff ($2*H_1$) | Face 91 ($H_1$) | Flap 97 ($H_2$) |
|---|---|---|---|---|
| Inch Dimensions | | | | |
| 21.00 | 14.00 | 21 | 10.50 | 3.50 |
| 22.00 | 14.67 | 21 | 10.50 | 4.17 |
| 22.75 | 15.17 | 21 | 10.50 | 4.67 |
| 23.56 | 15.71 | 21 | 10.50 | 5.21 |
| 24.81 | 16.54 | 21 | 10.50 | 6.04 |
| Metric Dimensions (mm) | | | | |
| 533.40 | 355.60 | 533.40 | 266.70 | 88.90 |
| 558.80 | 372.53 | 533.40 | 266.70 | 105.83 |
| 577.85 | 385.23 | 533.40 | 266.70 | 118.53 |
| 598.49 | 398.99 | 533.40 | 266.70 | 132.29 |
| 630.24 | 420.16 | 533.40 | 266.70 | 153.46 |

THREE-AROUND BROADSHEET NEWSPAPER PRINTING PRESS AND METHODS

This claims priority to U.S. Provisional Application No. 61/126,434, filed on May 5, 2008 and U.S. Provisional Application No. 61/135,705 filed on Jul. 23, 2008, the entire disclosures of which are hereby incorporated by reference herein.

BACKGROUND

The present invention relates generally to printing presses and more particularly to broadsheet newspaper printing presses.

The newspaper industry has been hit with high newsprint costs. Broadsheet newspapers, which typically are approximately 22 inches in height (11 inches when folded) and 15 inches wide, have for example switched to narrower widths such as 12 inches or to tabloid format.

Tabloid format has the disadvantage that sections are difficult to form without stitchers, and inserting is difficult as well.

Typical broadsheet newspapers also may run in straight or collect mode. A two-around printing plate cylinder has two printing plates mounted thereon. In collect mode, the two-around printing cylinder press results in an even number of sections, each former producing two sections.

Currently, three-section broadsheet newspapers are produced by straight mode production in conjunction with inserting as a post-press process, or by hand production.

BRIEF SUMMARY OF THE INVENTION

The present invention provides a broadsheet newspaper printing press including an image carrier carrying three images around in broadsheet newspaper format. The image carrier transfers the three images to a web. A folder imparts a longitudinal fold to the web and cuts the web into broadsheet newspaper pages. The folder includes a cylinder cross-folding the broadsheet newspaper pages off center. The cross-fold may be located 41% or less from an edge of the newspaper or 59% or more from an edge of the newspaper. The cross-fold may also be located 9 inches or more from an edge of the newspaper. The cross-fold is preferably located 10.5 inches from an edge of the newspaper.

The present invention also provides a web offset broadsheet newspaper printing press including a plate cylinder carrying at least one printing plate and a blanket cylinder carrying at least one blanket. The plate cylinder carries at least three images around in broadsheet newspaper format. The at least one blanket contacts a web to print the at least three images on the web. A folder imparts a longitudinal fold to the web, and cuts the web into broadsheet newspapers, the folder includes a cylinder cross-folding the broadsheet newspapers off center.

The present invention further provides a method of printing a three section broadsheet newspaper including the steps of: imaging a web with three images from a single plate cylinder; collecting the three section newspaper in a folder; and offsetting a fold in the newspaper so a face of the newspaper has a height of at least 9 inches and is greater than a height of a flap in the newspaper.

The present invention even further provides a method for converting a two-around broadsheet newspaper press to a three-around broadsheet printing press including the steps of: providing three images around a plate cylinder having a same circumference as that used for the two-around broadsheet printing press, printing the three images on a web; forming broadsheet pages from the web; and cross-folding broadsheet pages at a location so that one side of the cross-folded broadsheet page has a length similar to one of the newspapers printed by the two-around broadsheet newspaper press, while the other side is shorter.

The present invention additionally provides a method for printing a broadsheet newspaper including the steps of: providing three images around an image carrier of a printing press, printing the three images on a web; forming broadsheet pages from the web; running a folder in collect mode to collect three sections of broadsheet pages, and cross-folding the sections off center.

Moreover, the present invention provides a method of printing a three section broadsheet newspaper including the steps of: imaging a web with three images from a single image carrier; collecting the three section newspaper in a folder; and offsetting a fold in the newspaper so the fold is between about 25 percent to about 41 percent from a top or bottom edge of the newspaper, a face of the newspaper having a height greater than a height of a flap in the newspaper.

BRIEF DESCRIPTION OF THE DRAWINGS

A preferred embodiment of the present invention will be elucidated with reference to the drawings, in which.

DETAILED DESCRIPTION OF THE PREFERRED EMBODIMENTS

The present applicant has developed a novel way to reduce newsprint costs, permit broadsheet newspapers to reduce newsprint costs, permit standard-sized inserts and permit three broadsheet sections to be created during a collect run.

The present invention is highly advantageous as a retrofit to existing two-around broadsheet presses. For example a 44 inch circumference plate cylinder that previously printed two 22-inch broadsheet sections can be converted to print three 14⅔-inch broadsheet sections, each with a 10.5-inch front side and a 4.17-inch back side for example. During a collect operation in the folder, three sections can be provided without the need for inserting.

By using the three-around plate cylinder instead of a two-around plate cylinder, more pages per plate cylinder may be printed and three sections per web may be formed. Page capacity of a broadsheet newspaper may be efficiently increased by providing 50 percent more pages per plate cylinder without resorting to additional printing towers and associated supporting equipment such as folders.

Figure 1:
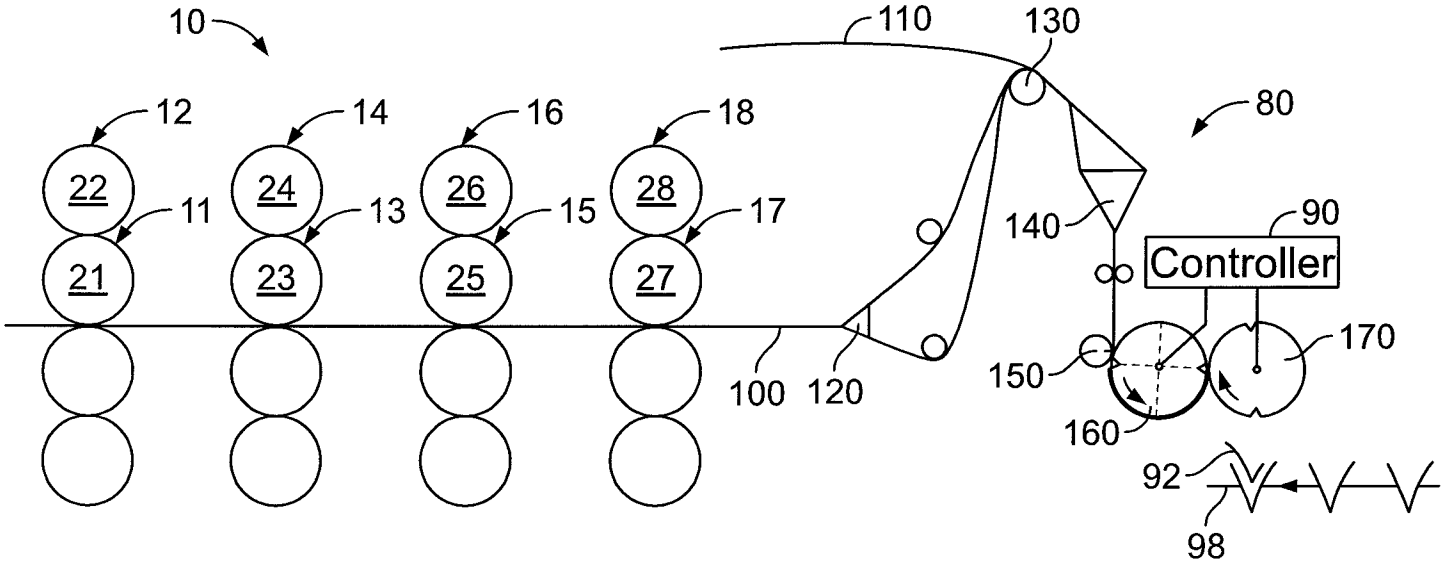
FIG. 1 shows a printing press according to a preferred embodiment of the present invention.

FIG. 1 shows a broadsheet newspaper printing press 10 having a printing section which may be for example, an offset lithographic web printing section with cyan, magenta, yellow and black printing units printing on a web 100. Each printing unit may include a plate cylinder 22, 24, 26, 28 carrying a corresponding printing plate 12, 14, 16, 18. Plate cylinders 22, 24, 26, 28 may have one plate around or three plates around in accordance with the present invention. Each printing plate 12, 14, 16, 18 may have a 44-inch circumference in the case of one plate around.

Web 100 may be slit by a slitter 120 into ribbons which are recombined, potentially with other ribbons 110, at a roller 130. Ribbons of web 100 then enter a folder 80 and pass to a former board 140 for folding the ribbons longitudinally. A cross cutter 150 of folder 80 then cuts ribbons into broadsheet newspaper pages which are gripped at a lead edge by a collect cylinder 160. The collect cylinder 160 has pins that selectively articulate to release a page for cross-folding, or retain a page to collect with other pages. Newspapers 92 are then tucked and cross-folded into a folding cylinder, for example, jaw cylinder 170. After folding, newspapers 92 are released to, for example, a fan wheel, a belt conveyor and a gripper pick-up, then delivered to a pocket conveyor 98, only the pocket conveyor being shown here for simplicity. The fan wheel and belt conveyor are shown for example in U.S. Pat. No. 6,733,341, hereby incorporated by reference herein.

A controller 90 may set the phasing between pins and tuckers of collect cylinder 160, and control the phasing of jaws of folding cylinder 170, so that a cross-fold distance can be set. Owing to the phasing control, the cross-fold may be set so a face of the newspaper has a height of, for example, at least nine inches. Preferably, the cross-fold is set so the face of the newspaper has a height of 10.5 inches. The cross-fold may be located 41% or less from an edge of the newspaper or 59% or more from the edge of the newspaper. The offset fold advantageously permits smaller format newspapers to receive standard inserts for example by providing a longer side. Alternatively, the cross-fold position may be set mechanically.

Broadsheet newspapers having a height of 14.67 inches, for example, thus can be formed, while still permitting the newspaper to receive standard advertising inserts. Newsprint savings of (22−14.67)/22 or 33 percent advantageously can be achieved while retaining the advantages of a broadsheet format. One advantage includes permitting sectioning without stitching or separate inserting, by using a collect mode. The three-around press of the present invention thus can provide three broadsheet sections, for example a main section, sports section and business section, without any further inserting.

Figure 2A:
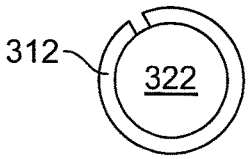
FIG. 2A (Prior Art)
FIGS. 2A and 2B show prior art plate cylinders with a one-around printing cylinder and two-around printing cylinder, respectively.

For example, as shown in the prior art, FIG. 2A shows one broadsheet newspaper printing cylinder configuration for a straight mode operation. Plate cylinder 322 has a printing plate 312 mounted thereon. One revolution of plate cylinder 322 prints one image of printing plate 312.

Figure 2B:
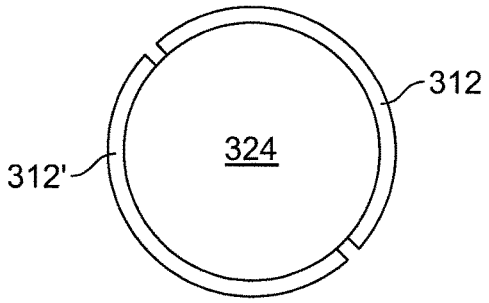
FIG. 2B (Prior Art)

In FIG. 2B (prior art), plate cylinder 324 is a two-around plate cylinder and has two printing plates 312 and 312' mounted thereon. This two-around configuration is used for straight or collect mode production. One revolution of plate cylinder 324 produces one image from each of printing plates 312 and 312', thus one revolution of two-around printing cylinder 324 produces twice as many pages as printing cylinder 322 shown in FIG. 2A.

A plate cylinder and printing plate mounted thereon typically has a circumference of 44 inches. The typical two-around plate cylinder shown in FIG. 2B carries two printing plates 312, 312' around one plate cylinder 324, thus printing newspaper pages having a height of 22 inches.

Figure 3A:
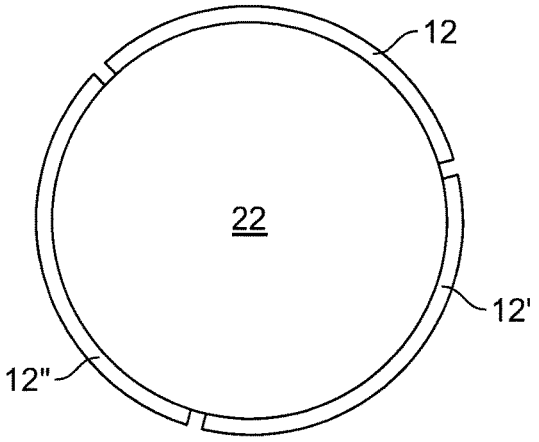
FIGS. 3A and 3B each show a three-around printing cylinder according to a preferred embodiment of the present invention.
Figure 3B:
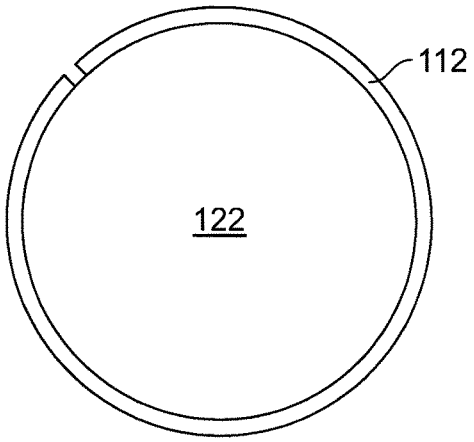

FIGS. 3A and 3B show a preferred embodiment of a three-around printing cylinder in accordance with the present invention. In FIG. 3A, three printing plates 12, 12', 12" are mounted on plate cylinder 22. In FIG. 3B, one printing plate 112 may be mounted on plate cylinder 122; however, printing plate 112 carries three distinct broadsheet page images. Thus, one revolution of plate cylinder 22 provides three images; one each from printing plate 12, 12', 12", and one revolution of plate cylinder 122 provides three images; each image originating from printing plate 112. Printing plates 12, 12', 12" may print the same or different images. The images on printing plate 112 may also be the same or different. Printing cylinders 22, 122 may be 48 inches across and each carry four images across. Slitting a 48-inch-wide web may provide two ribbons each having a width of 24 inches, and after combining the ribbons and former folding a 12-inch-wide 8-page-section thus can be produced.

In the preferred embodiments of the present invention shown in FIGS. 3A and 3B, plate cylinders 22, 122 are three-around plate cylinders and have a circumference of 42 to 50 inches with the printing plates mounted thereon, the circumference most preferably being 44 inches. Newspaper pages printed by three-around cylinders 22, 122 may have a height of approximately 14 to 16.6 inches, and height most preferably being 14.67 inches.

Figure 4A:
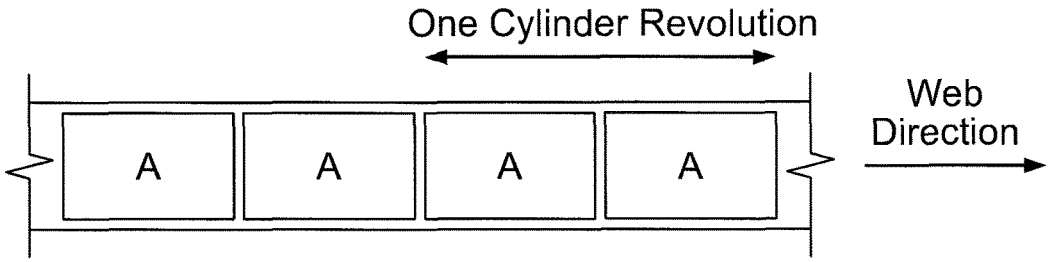
FIG. 4A (Prior Art)
FIGS. 4A and 4B show layouts for the prior art printing cylinders shown in FIGS. 2A and 2B respectively.
Figure 4B:
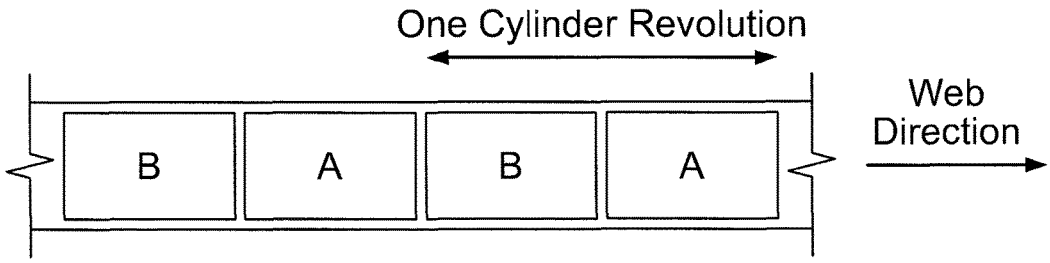
FIG. 4B (Prior Art)

FIGS. 4A and 4B show a layout of section pages on the web in a traditional two-around newspaper press in straight mode (FIG. 4A) production and collect mode (FIG. 4B) production respectively. In straight production, the same image "A" is printed repeatedly. Here, plate cylinder 324 (FIG. 2B) is running in straight mode so printing plates 312 and 312' are printing identical images, image A, on the web. Thus, one revolution produces two identical images A.

In collect production, FIG. 4B, printing plate 312 is carrying an image, A, while printing plate 312' is carrying a second image, B. One revolution produces two distinct images, A and B.

Figure 5A:
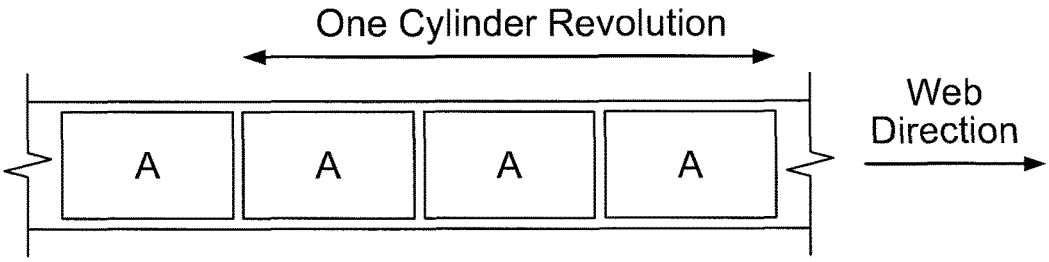
FIGS. 5A and 5B show layouts for the printing cylinders shown in FIGS. 3A and 3B according to preferred embodiments of the present invention.
Figure 5B:
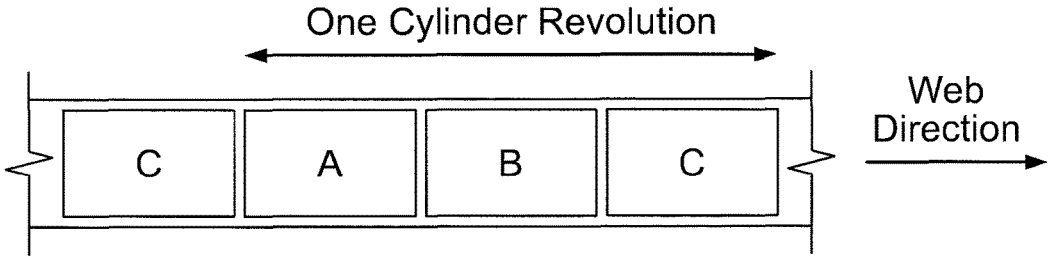

In accordance with a preferred embodiment of the present invention, FIGS. 5A and 5B show a layout of section pages on a three-around press in straight mode (FIG. 4A) production and collect mode (FIG. 4B) production respectively. For straight production, three identical images "A" are printed. Thus, printing plates 12, 12' and 12" (FIG. 3A) are each imaged with image "A". Alternatively, printing plate 112 may be imaged with three images "A" in straight mode. A folder for the three-around press running in straight mode may be the same as a folder suited for traditional one- and two-around presses with cutoff matching the page length.

During collect production, the layout is shown in FIG. 4B. One revolution of printing cylinder 22 or 122 produces three distinct images, C, B and A. Here, printing plates 12, 12' and 12" are imaged with images C, B, and A, respectively, while printing plate 112 is imaged with three distinct images C, B and A. A folder for a three-around press running in collect mode must be able to collect three sections rather than the usual two.

A suitable folder may include collect and jaw folding cylinder geometries such as a 4-part collect, 4-part jaw, or a 7-part collect, 7-part jaw, and may include articulating pins for collecting and releasing the newspaper sections.

Figure 6:
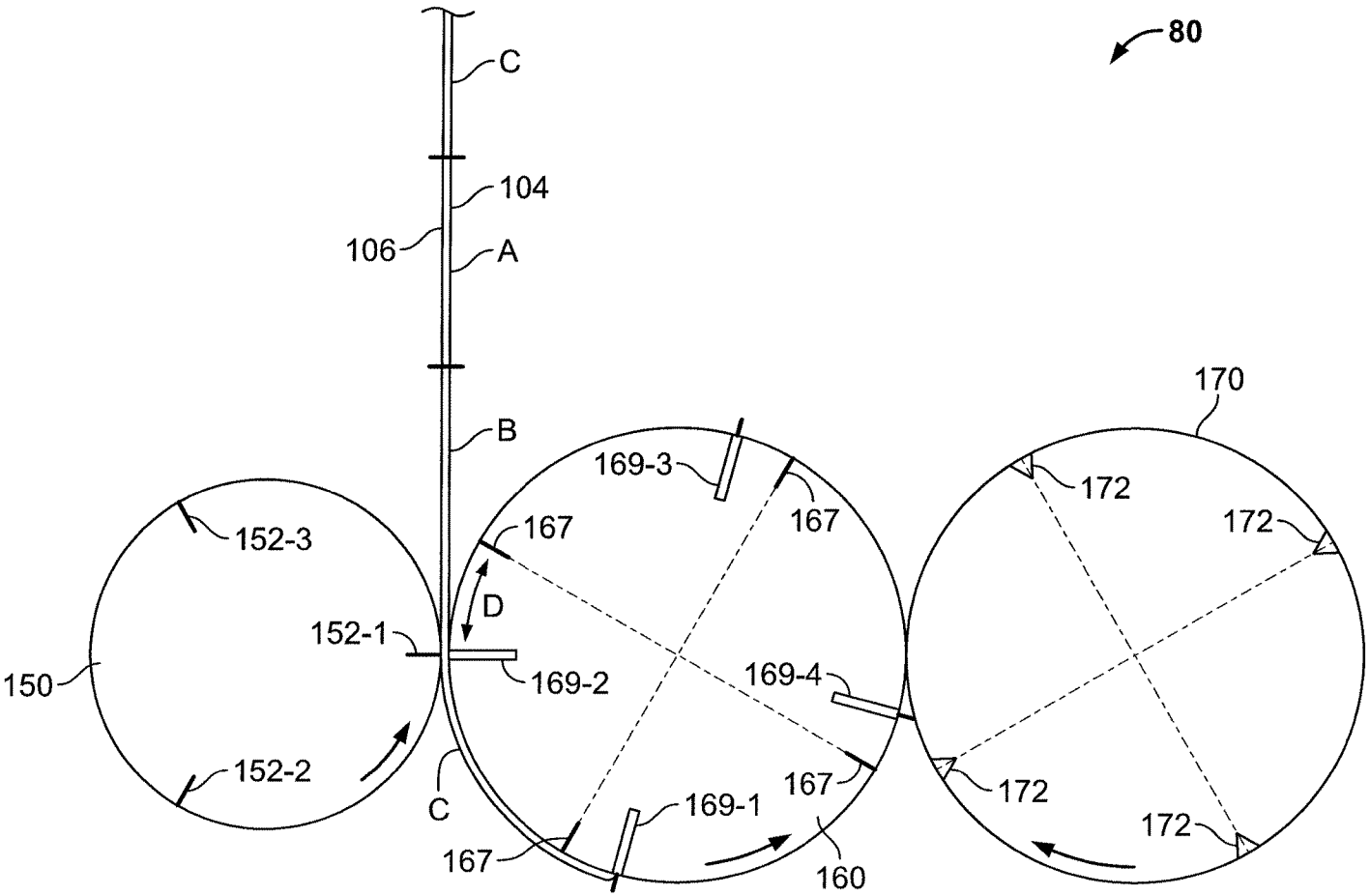
FIG. 6 shows a cross cutter, collect cylinder and jaw cylinder of the printing press shown in FIG. 1.

FIG. 6 shows part of folder 80 with collect cylinder 160 having four sets of pins 169-1, 169-2, 169-3, 169-4 which may be located on a spider or gripper support and four tuckers 167 which may be actuated by a tucker support. The circumference of collect cylinder 160 should be approximately four times the height of the newspaper, for example 4*14.67 or 58.7 inches. Tuckers 167 thus can be located approximately a distance D, for example 4.17 inches, from pin sets 169-1, 169-2, 169-3, 169-4 in the direction of rotation, corresponding to the shorter side of the folds of the broadsheet newspaper.

Web 100 has been printed with images C, B and A, slit into ribbons 104, 106 and combined to form corresponding sections C, B and A upstream (FIG. 1). Cross cutter 150 having knives 152 cuts ribbons 104, 106 which are pinned to collect cylinder 160 by pin sets, hereinafter pins, 169-1, 169-2, 169-3, 169-4. Thus, section C was pinned by pin 169-1 and cut by 152-1 to a desired height of, for example, 14.67 inches. Second section B is pinned by pin 169-2 and will be cut by knife 152-2 to the desired length. In straight mode production, each pin 169-1, 169-2, 169-3, 169-4 gathers only one section. In collect mode production, collect cylinder 160 continues rotating and each pin 169-1, 169-2, 169-3, 169-4 continues collecting a desired number of sections. After each of the desired three sections are collected, tucker 167 interacts with jaw 172 on jaw cylinder 170 folding the collected sections into jaw 172.

Figure 7A:
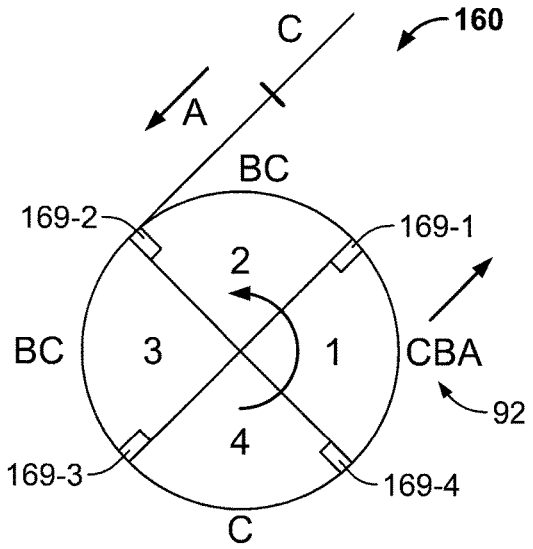
FIGS. 7A to 7D show schematically the collect cylinder shown in FIG. 6 running during collect mode production.

FIGS. 7A to 7D show schematically collect cylinder 160 running during collect mode operation and rotated a quarter-revolution at each position 0°, 90°, 180°, 270°, respectively. A first newspaper 92 has been collected having three sections, section A, section B and section C pinned at pin 169-1. Section C is the back section of the newspaper 92, collected first and nearest cylinder 160. Section A is the front section of newspaper 92 and collected last. As shown in FIG. 7A, a first section to be collected, section C, a second section to be collected, section B and a third section to be collected, section A have been collected at pin 169-1. Newspaper 92 collected at pin 169-1 will be tucked into jaw cylinder 170 and transported further downstream.

Figure 7B:
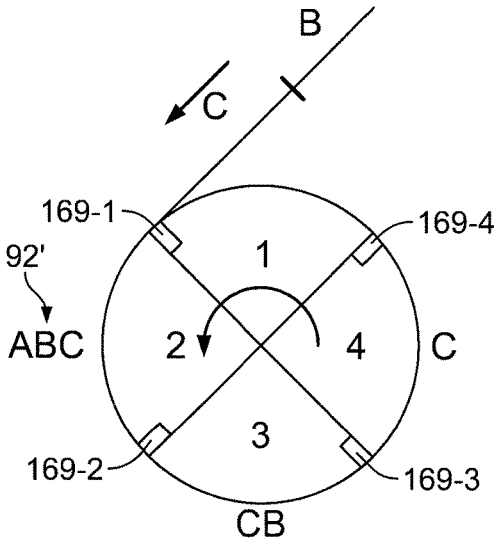
Figure 7C:
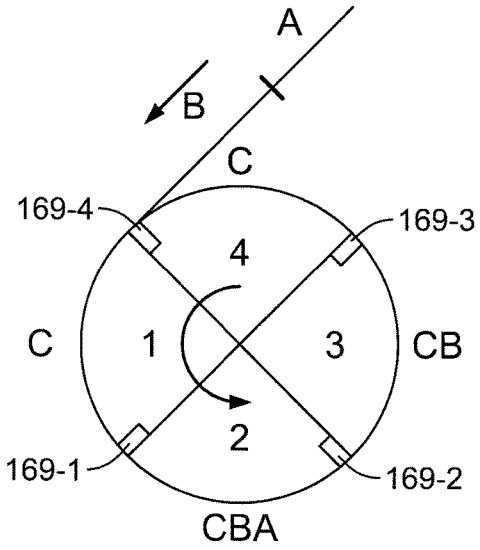
Figure 7D:
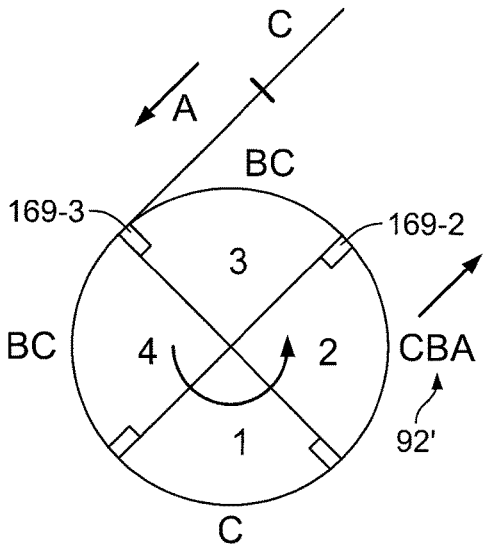

As shown in FIG. 7B, collect cylinder 160 has rotated 90°, newspaper 92 has been tucked into jaw cylinder 170 (FIG. 6) and a new section C is collected at pin 169-1. A second newspaper 92' has been collected at pin 169-2 and will be tucked into jaw folder 170. FIG. 7C shows section B being collected on top of section C at pin 169-4 as collect cylinder 160 rotates another quarter-revolution. At cylinder position 270° shown in FIG. 7D, second newspaper 92' is tucked into jaw folder 170 (FIG. 6) and a third newspaper 92" is formed at pin 169-3 when section A is collected on top of sections B and C.

Controller 90 (FIG. 1) may control phasing of tuckers 167 via a first servomotor and a tucker support to match the phasing of jaws 172 via a second servomotor. The first servomotor may be controlled by controller 90 to adjust location of pin sets 169-1, 169-2, 169-3, 169-4, relative to tucker blades 167. Controller 90 may also control a fan, any subsequent conveyors, an inserter feeder and pocket conveyor 98. Inserts from an insert feeder preferably include, for example, 10.5-inch inserts. Thus, a broadsheet newspaper with 10.5-inch inserts may be formed. The inserter may be for example similar to one in U.S. Pat. No. 6,082,724 which is hereby incorporated by reference herein.

While folder 80 has been shown with a collect cylinder including four pin sets and four tuckers, other configurations including seven pin sets and seven jaw configurations are also possible. Moreover, while the folder has been shown with a collect cylinder with pins and tuckers, other configurations such as a folder employing rotary tuckers and folding rollers, a so-called rotary blade folder, is possible. In that case, the jaw cylinder is replaced by folding rollers which receive the folded signatures from a collect cylinder. U.S. Pat. No. 6,688,224 for example is hereby incorporated by reference herein as showing a rotary blade folder.

Furthermore, the printing press shown in FIG. 1 is a web-offset printing press; however, the printing press may be a flexographic printing press and/or include an image carrier printing directly on a web.

Figure 8:
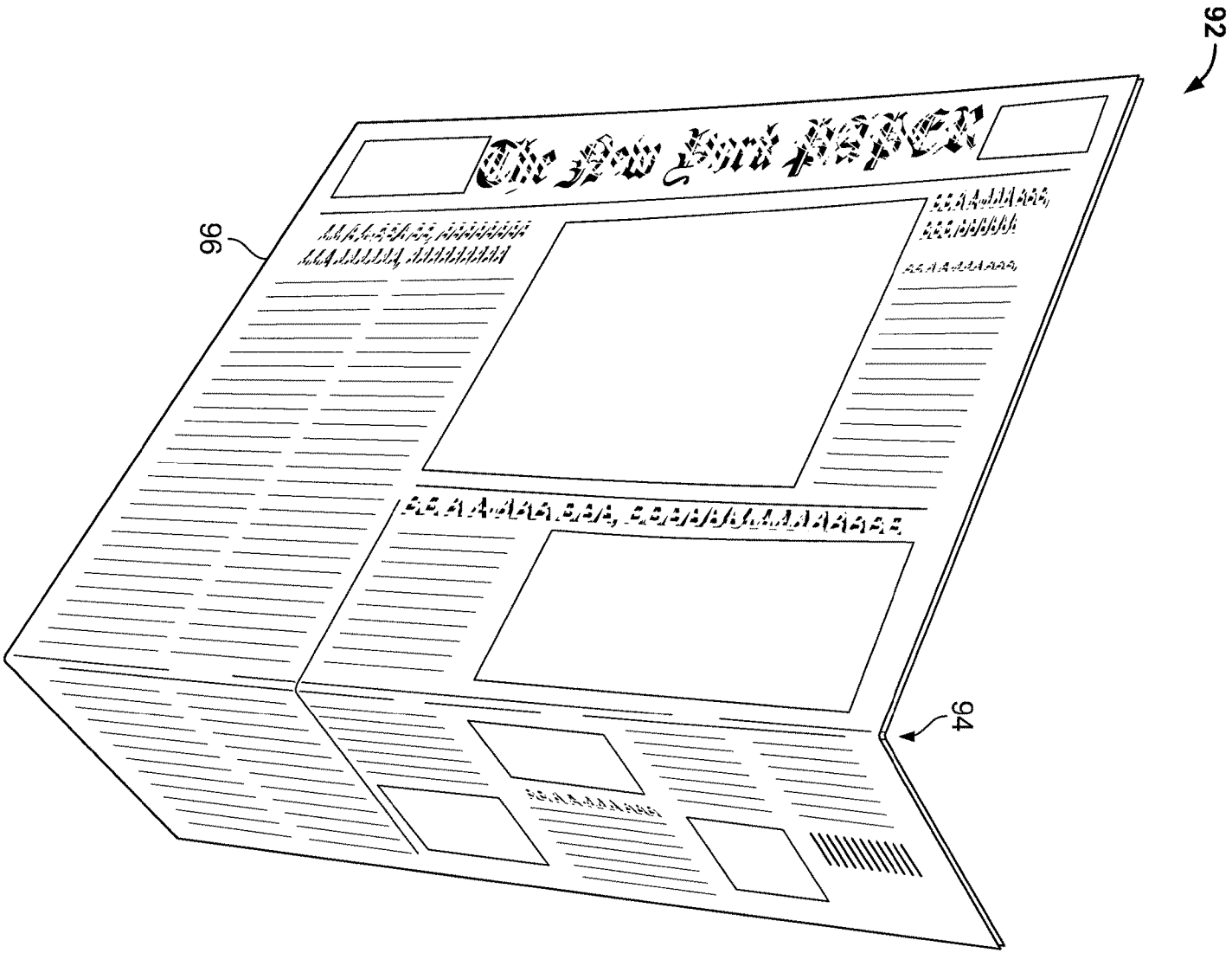
FIGS. 8 to 13 show a plurality of views of a newspaper formed according to a preferred embodiment of present invention.

FIG. 8 shows a perspective view of broadsheet newspaper 92 having a cross-fold 94 and a longitudinal-fold 96 according to the present invention.

Figure 9:
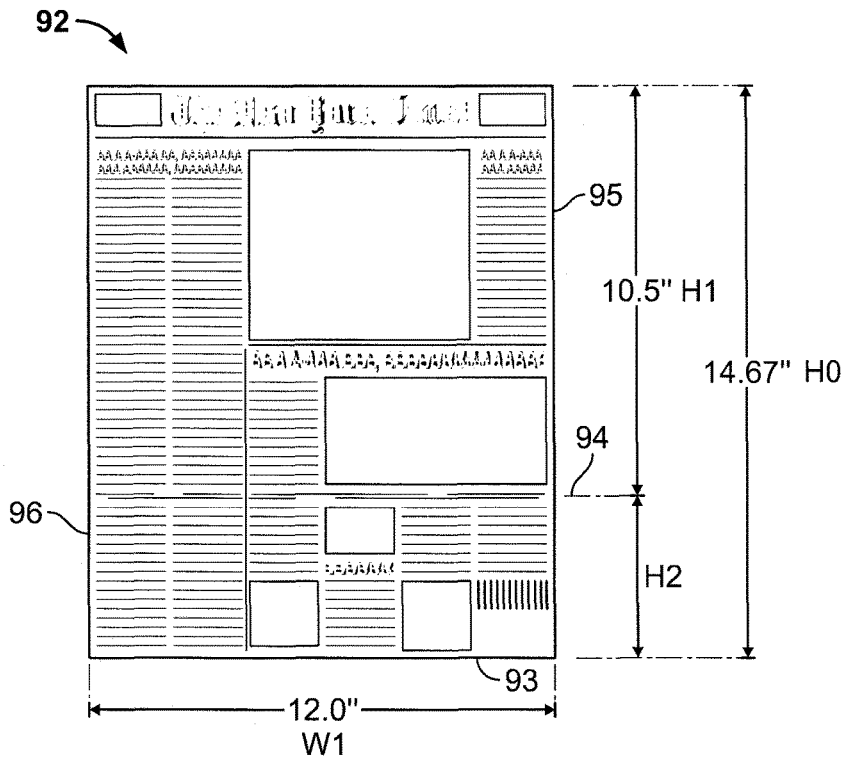

FIG. 9 shows a front view of broadsheet newspaper 92. Newspaper 92 has a height $H_0$ and a width $W_1$ when newspaper 92 is longitudinally-folded, but not cross-folded. Height $H_0$ may be, for example, 14.67 inches and width $W_1$ may be, for example, 12.0 inches. The width may also be, for example, between 10.0 and 12.5 inches. Height $H_0$ includes a height $H_1$ above cross-fold 94 and a height $H_2$ below cross-fold 94. Height $H_1$ may be, for example, 10.5 inches, or 71.6 percent of newspaper height $H_0$. Height $H_2$ may be, for example, 4.17 inches or 28.4 percent of newspaper height $H_0$. An edge 93 may be, for example, the pinned or gripped lead edge, an edge 96 the longitudinally-folded edge, and an edge 95 the edge opposite the longitudinally folded edge.

Further preferred embodiments provide a cross-fold may be located 41% or less from an edge 93 of the newspaper or 59% or more from the edge 93 of the newspaper. Thus, height $H_1$ may be 59% or more or 41% or less of total newspaper height, $H_0$, respectively. Consequently, height $H_2$ may be 41% or less or 59% or more of total newspaper height $H_0$, respectively. Cross-fold 94 may also be located 9 inches or more from an edge of the newspaper. The cross-fold is preferably located 10.5 inches from the edge of the newspaper as shown in FIG. 9, the height $H_1$ above cross-fold 94 is 10.5 inches. (See FIGS. 9 and 15).

Figure 10:
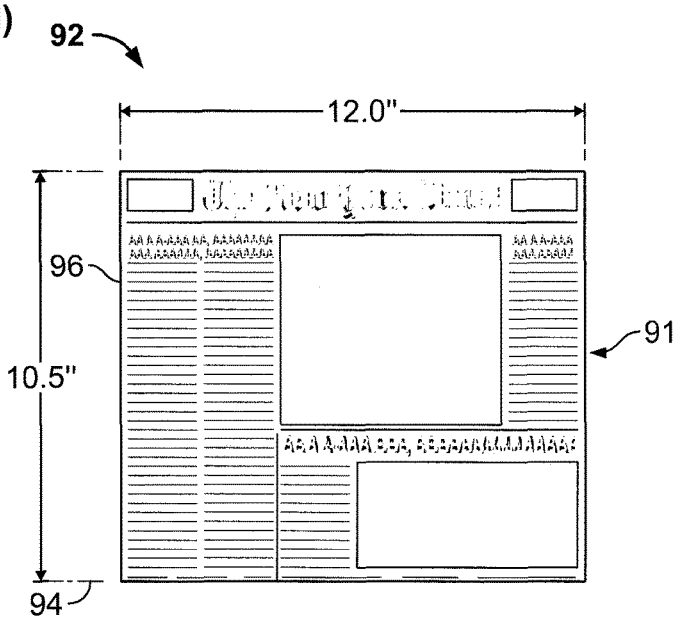

FIG. 10 shows a front view of newspaper 92 folded at cross-fold 94. Height $H_2$ of newspaper 92 has been folded behind height $H_1$ of newspaper 92 forming a flap behind a face 91 of newspaper 92.

Figure 11:
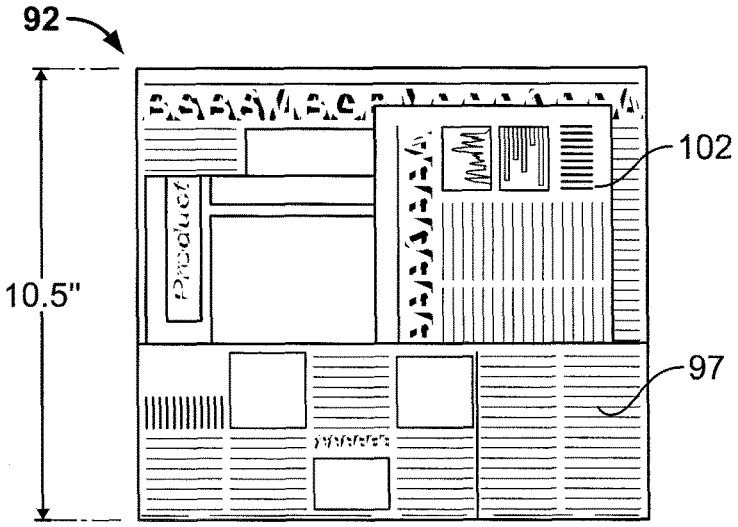

FIG. 11 shows a back view of the newspaper 92 shown in FIG. 11 including a plurality of inserts 102. Inserts 102 may be placed inside flap 97. Inserts 102 may be standard sized inserts, for example, 10.5 inches in height and be equal to height $H_1$ of newspaper 92. Inserts 102 may also be a combination of sizes. Inserts may be fed from a hopper, as from the incorporated by reference '724 patent. Thus, a broadsheet newspaper with 10.5-inch inserts 102 may be formed.

Figure 12:
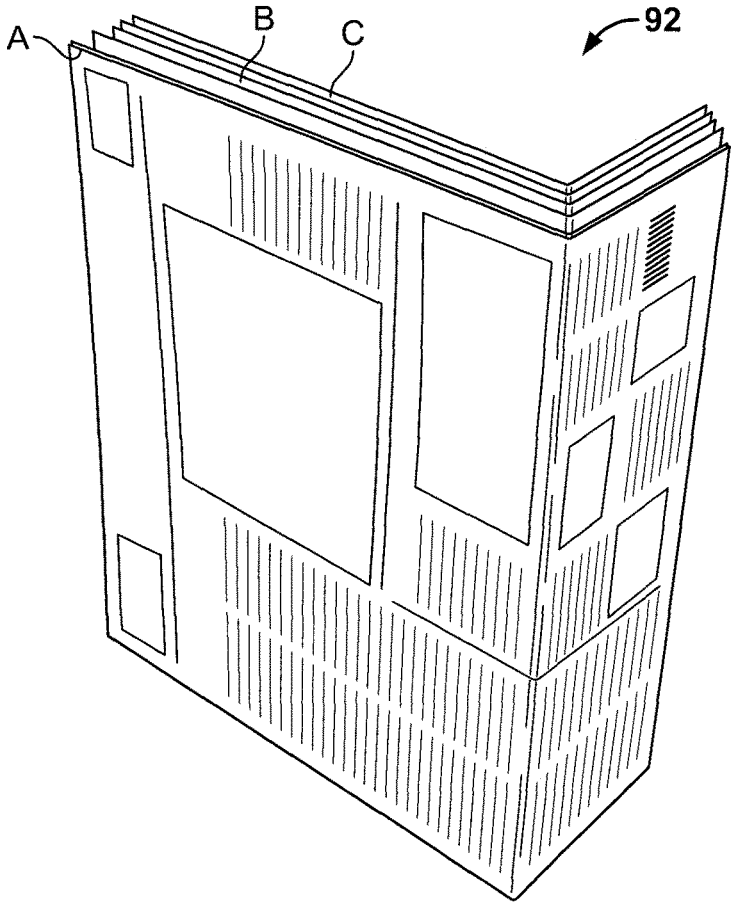

As shown in FIGS. 7 and 12, newspaper 92 may include multiple sections A, B, C. Each section A, B, C may be based on a desired layout of newspaper 92. For example, section A may include news, section B may include sports and section C may include business. Each section A, B, C may include a plurality of pages or sheets. In accordance with the present invention, sections in multiples of three may be included in newspaper 92, for example, three sections, six sections, nine sections, etc. Sections may include, for example, entertainment, science, fashion, world events, local events, culinary etc.

Figure 13:
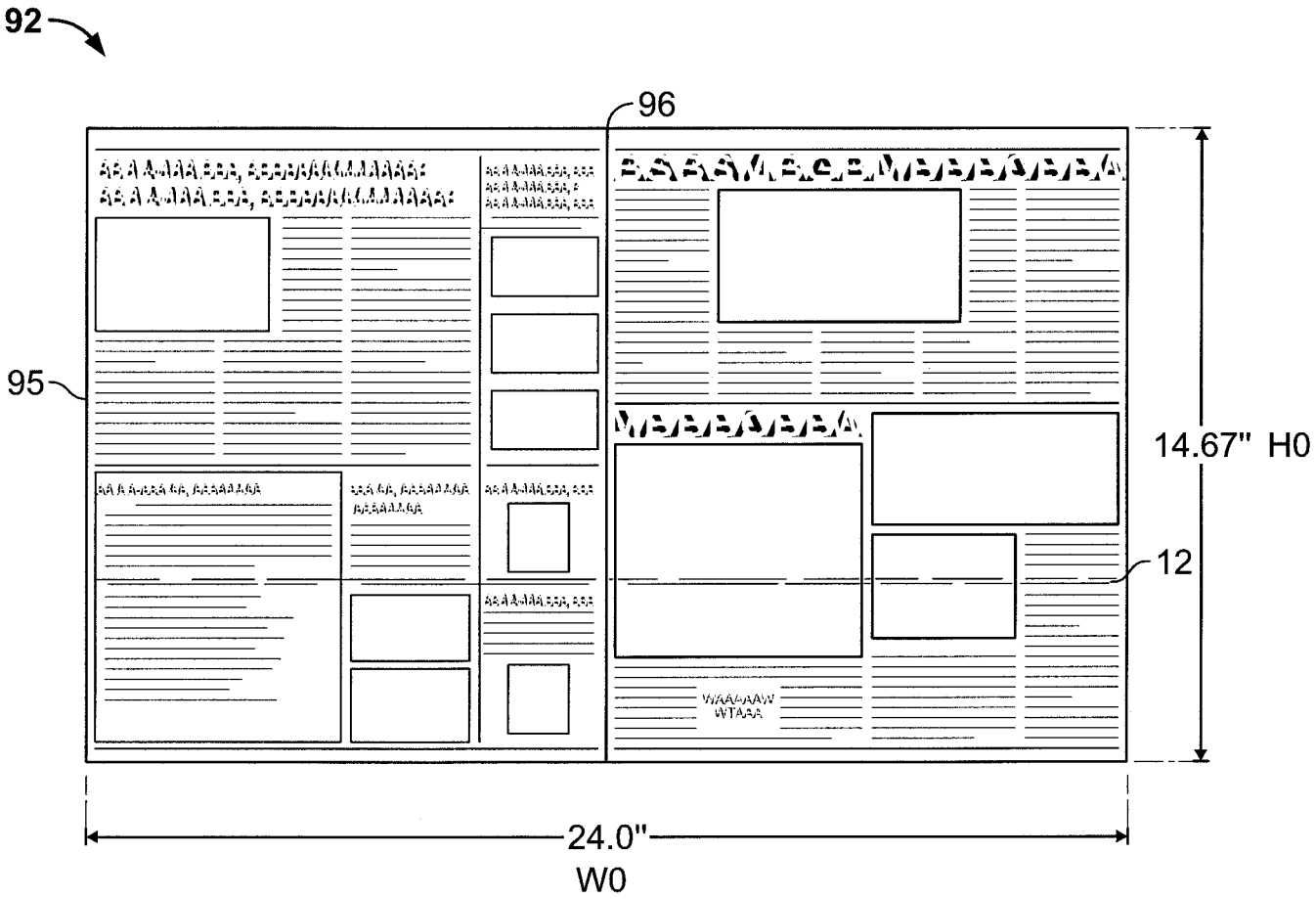

Newspaper 92 may be completely unfolded as shown in FIG. 13. When unfolded at longitudinal-fold 96, newspaper 92 has an entire width $W_0$. Entire width may be $W_0$, for example, 24.0 inches. Longitudinal-fold 96 may be located in a middle of entire width $W_0$, for example, at 12.0 inches from an edge 95 of newspaper 92. Thus, when folded at longitudinal-fold 96, newspaper 92 has a width $W_1$ of, for example, 12 inches, as shown in FIG. 9.

Figures 14, 15:
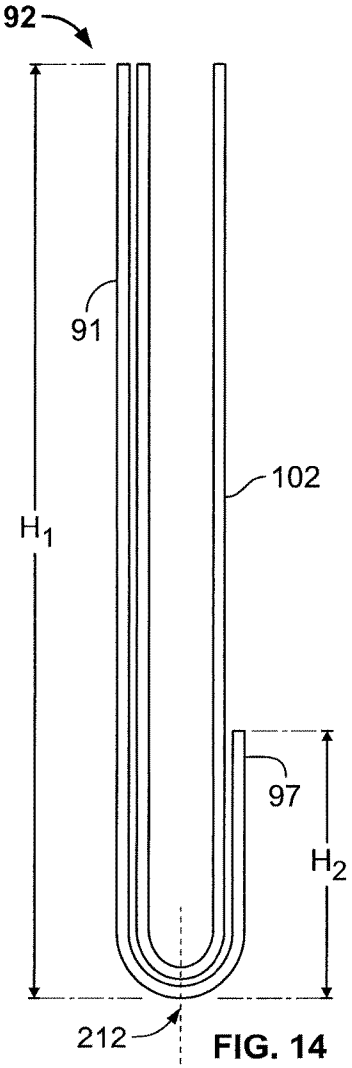
FIGS. 14 and 15 show a newspaper and table of dimensions for a newspaper formed according to preferred embodiments of the present invention.

FIGS. 14 and 15 show newspaper 92 and a table of dimensions for variations in accordance with the present invention. The table of dimensions serves for exemplary purposes and the present invention is not limited thereto. Thus, face 91 of newspaper 92 may have a height $H_1$ of, for example, 10.50 inches and height $H_2$ of flap 97 may vary between, for example, 3.50 inches and 6.04 inches, while inserts 102 may still have a standard cutoff length of 21 inches as described herein. The total height $H_0$ of newspaper 92 may range between 14 inches and 16.54 inches, for example. Heights, $H_1$, $H_2$, may be measured from the cross-fold 212 to the head or tail end of the newspaper, respectively. The metric equivalents are also provided in FIG. 15.

A three-around printing press may be advantageous when printing in straight mode because production speeds are higher resulting in three newspapers per press revolution rather than one or two, as in the cases of traditional presses having only one or two pages around.

A three-around printing press may be advantageous when printing in collect mode, because sections are produced in multiples of three (3, 6, 9, etc. . . . ), rather than in multiples of two (2, 4, 6, etc. . . . ) as in traditional two-around presses. Furthermore, some newspaper presses have capabilities for full color on only some of the webs. In these cases, having three pages around increases the color page capacity of the press by 50 percent over a two-around press.

Retrofitting of existing presses to adapt to the three-around style may occur by adding, filling or removing existing printing plate lock-ups as necessary. Printing plate lock-ups may be filled, for example, by adding fiberglass, or another suitable material, to fill the voids, in order to provide a suitable surface for printing an image. Alternatively, a metal bar may be welded into the cylinder to fill the void. The remaining voids may be filled with resin to provide a suitable surface.

Alternatively, the lock-up apparatus may be physically removed from the cylinder. The cylinder may then be filled or repaired so a printing plate can be mounted thereon for successful imaging. For one plate around printing cylinders, printing plates will now be imaged with three images as opposed to one or two images. In addition, a new printing plate cylinder designed to print three images may be employed.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A broadsheet newspaper printing press comprising:

an image carrier carrying three images around in broadsheet newspaper format, the three images being different from each other;

the image carrier transferring the three images to a web;

a folder imparting a longitudinal fold to the web and cutting the web into broadsheet newspaper pages, the folder including a cylinder cross-folding the broadsheet newspaper pages off center so one side of the broadsheet newspaper pages has a length of 9 inches or more and the other side has a length of 6.5 inches or less, the folder collecting at least three sections to form a broadsheet newspaper, each section derived from one of the three images.

2. The broadsheet newspaper printing press as recited in claim 1 wherein the folder is a jaw folder or a rotary blade folder.

3. The broadsheet newspaper printing press as recited in claim 1 wherein the image carrier has a circumference between 42 and 50 inches.

4. A web offset broadsheet newspaper printing press comprising:

a plate cylinder carrying at least one printing plate, the plate cylinder carrying at least three images around in broadsheet newspaper format, the three images being different from each other;

a blanket cylinder carrying at least one blanket, the at least one blanket contacting a web to print the at least three images on the web; and a folder for imparting a longitudinal fold to the web, and cutting the web into broadsheet newspapers, the folder including a cylinder cross-folding the broadsheet newspapers off center so one side of the broadsheet newspaper pages has a length of 9 inches or more and the other side has a length of 6.5 inches or less;

the folder collecting at least three sections to form a broadsheet newspaper, each section derived from one of the three images.

5. The web offset broadsheet newspaper printing press as recited in claim 4 wherein the at least one printing plate is a single printing plate imaged with three images.

6. The web offset broadsheet newspaper printing press as recited in claim 4 wherein the plate cylinder is a three-around plate cylinder carrying three printing plates.

7. The web offset broadsheet newspaper printing press as recited in claim 6 wherein each of the three printing plates is imaged with one image.

8. The web offset broadsheet newspaper printing press as recited in claim 4 wherein the folder is a jaw folder or a rotary blade folder.

9. The web offset broadsheet newspaper printing press as recited in claim 4 wherein the plate cylinder has a circumference between about 42 and about 50 inches.

10. A method for printing a broadsheet newspaper comprising the steps of:

providing three images around an image carrier of a printing press, printing the three images on a web;

forming broadsheet pages from the web;

running a folder in collect mode to collect three sections of broadsheet pages, and cross-folding the sections off center so one side of the broadsheet newspaper pages has a length of 9 inches or more and the other side has a length of 6.5 inches or less.

* * * * *